US005289656A

United States Patent [19]

Vetter

[11] Patent Number: 5,289,656

[45] Date of Patent: Mar. 1, 1994

[54] GEARED CASEMENT WINDOW HINGES

[75] Inventor: Gregory V. Vetter, Owatonna, Minn.

[73] Assignee: Truth Division of SPX Corporation, Owatonna, Minn.

[21] Appl. No.: 908,464

[22] Filed: Jul. 6, 1992

[51] Int. Cl.[5] ..... E05D 15/42

[52] U.S. Cl. ..... 49/250; 49/260; 49/261; 16/354

[58] Field of Search ..... 49/250, 260, 261, 339, 49/346; 16/354, 361

[56] References Cited

U.S. PATENT DOCUMENTS

| | | | |
|---|---|---|---|
| 726,362 | 4/1903 | Shrivell | 49/260 |
| 1,341,366 | 5/1920 | Fournier | 49/260 |
| 1,600,796 | 9/1926 | Campbell | 49/260 |
| 1,910,344 | 5/1933 | Kotler | 49/260 |
| 2,746,101 | 5/1956 | Lickteig | 16/354 X |
| 4,980,947 | 1/1991 | McQuigge | 16/361 X |

FOREIGN PATENT DOCUMENTS

| | | | |
|---|---|---|---|
| 9856 | of 1888 | United Kingdom | 49/260 |
| 609685 | 10/1948 | United Kingdom | 49/260 |

*Primary Examiner*—Peter M. Cuomo
*Assistant Examiner*—Michael J. Milano
*Attorney, Agent, or Firm*—Wood, Phillips, Van Santen, Hoffman & Ertel

[57] ABSTRACT

A hinge structure for supporting a window sash on a window frame. The hinge structure includes sash arms secured to opposite sash sides, and a shaft having gears fixed to its ends and supported by tracks for longitudinal movement along opposite sides of the frame. The gears engage racks on each of the tracks. The sash arms are carried with the shaft in its longitudinal movement along the tracks.

18 Claims, 2 Drawing Sheets

Fig. 4
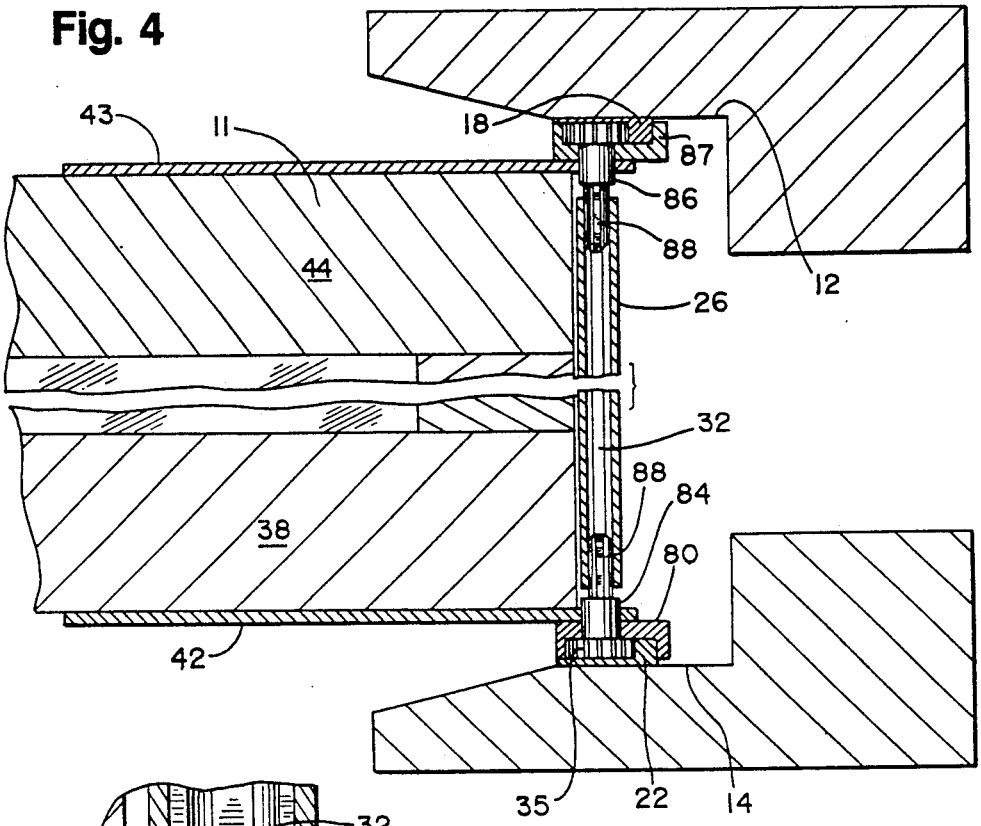
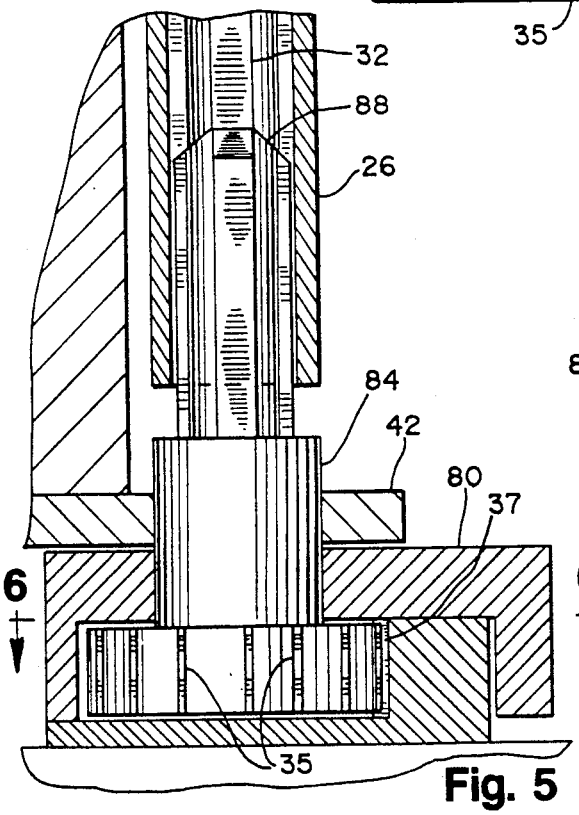
Fig. 5
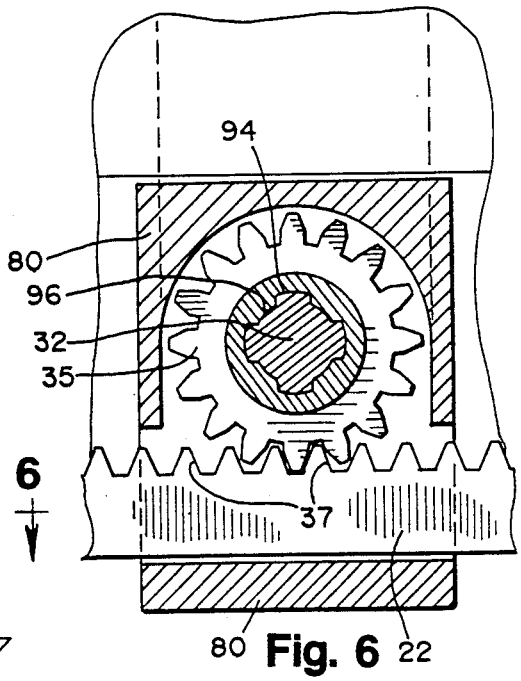
Fig. 6

GEARED CASEMENT WINDOW HINGES

BACKGROUND OF THE INVENTION

1. Technical Field

The present invention is directed toward a hinge for a casement window, and more particularly toward a geared hinge for a casement window.

2. Background Art

A casement window has a window sash movably mounted in a frame by a pair of hinges located between the window frame and upper and lower horizontal sides of a sash. Both the upper and lower hinges typically include a track mountable to the window frame and a sash arm mounted along the horizontal sides of the window sash. A support arm is pivotally connected to the track and the sash arm. A first mounting shoe slidingly supports the sash arm on the track.

During operation, the casement window is movable between a closed position and an egress position. When in the egress position, the window sash extends generally normal to the window frame and adjacent to one side of the window jamb. The egress position maximizes the amount of unobstructed opening to facilitate escape through the casement window in the event of an emergency. When in the closed position, the inside of the casement window can be easily cleaned from the room interior. However, the outside of the window is not readily accessible in the egress position since the sash is too close to the window jamb to allow a person to reach out and wash the outside of the window.

More complex prior art structures include a second mounting shoe having one end of the support arm pivotally mounted thereto. The second mounting shoe can be manipulated to either be slidingly received by the track or fixed to the track. During normal operation between the closed and egress positions, the second mounting shoe is fixed.

The prior art casement window hinges with two mounting shoes allow the casement window to achieve a wash position in addition to the egress position. Typically to obtain the wash position, these hinges are first placed in the egress position, then both top and bottom hinges must be manipulated to release the second mounting shoe, and finally both the top and bottom of the sash must be grasped and pushed simultaneously towards the wash position. If either the top or the bottom of the sash alone is driven, the casement window may twist and bind and not move into the wash position. If the person forgets to release the second mounting shoe for one of the hinges and the sash is driven with sufficient force, the casement window sash, the hinges, or window glass can be broken causing unneeded expense and injury.

Still other casement hinges include sophisticated mechanical apparatus which achieve both egress and wash positions through continuous cranking by an operator. At some point, the movement of the sash becomes a purely sliding motion with no rotation of the casement window. When the sliding motion occurs, these prior art hinges require complex structures to drive both the top sash and the bottom sash simultaneously towards the wash position.

The present invention is directed toward overcoming one or more of the problems set forth above.

SUMMARY OF THE INVENTION

In one aspect of the present invention, a window is provided having a window sash and a window frame. A hinge structure for supporting opposite sides of the sash to the frame includes first and second sash arms secured to the opposite sash sides. A shaft extends between opposite sash sides and includes gears fixed to its opposite ends. First and second tracks are mounted on opposite sides of the window frame adjacent the opposite sash sides when the sash is closed. The first and second tracks support the shaft ends for longitudinal movement along the tracks, and the sash arms are carried with the shaft in such movement. Racks associated with each of the first and second tracks engage the gears.

In another aspect of the invention, a casement window hinge mounts a casement window to a window frame, provides normal operation of a window sash from a closed position to an egress position, and provides a washability position. The casement window sash has upper and lower horizontal sides and inner and outer vertical sides. Upper and lower tracks are mountable to a window sill. Upper and lower sash arms are pivotable relative to the upper and lower tracks at ends of the sash arms and support the upper and lower horizontal sides of the sash. A shaft rotates in a shaft stile mounted to the inner vertical side of the sash, and has upper and lower gears fixed to its ends. Racks located on the upper and lower tracks rotate the upper and lower gears when the casement window is moved along the upper and lower tracks. A C-shaped shoe slider connected to the pivoting ends of the upper and lower sash arms and to the shaft stile slidably supports the upper and lower sash arms on the upper and lower tracks and holds the upper and lower gears against the racks.

In a further aspect of the invention, a support arm pivotally connects the lower track with the lower sash arm, and the lower track also includes an anchor mount on the window sill with a mounting shoe pivotally connected to the support arm and slidable along the anchor mount. The mounting shoe is fixed to the anchor mount during normal operation, and is fixed to the movable shoe and released for sliding along the anchor mount for adjusting the window to a washability position.

It is an object of the present invention to provide a simple casement window hinge which is can be easily and inexpensively manufactured and installed.

It is a further object of the invention to provide a casement window hinge which can be easily converted between operations providing egress and washability positions when opened.

Another object of the invention is to provide a casement window hinge which can be reliably operated without risk of damaging the window, frame, or hinge.

BRIEF DESCRIPTION OF THE DRAWINGS

FIG. 4 is a broken side section view of the geared casement hinge of the present invention;

FIG. 5 is a side sectional view of a lower hinge of the geared casement hinge of the present invention; and FIG. 6 is a cross-sectional view, taken along line 6—6 of FIG. 5, of the toothed gear and track of the present invention.

DESCRIPTION OF THE PREFERRED EMBODIMENT

Figure 1:
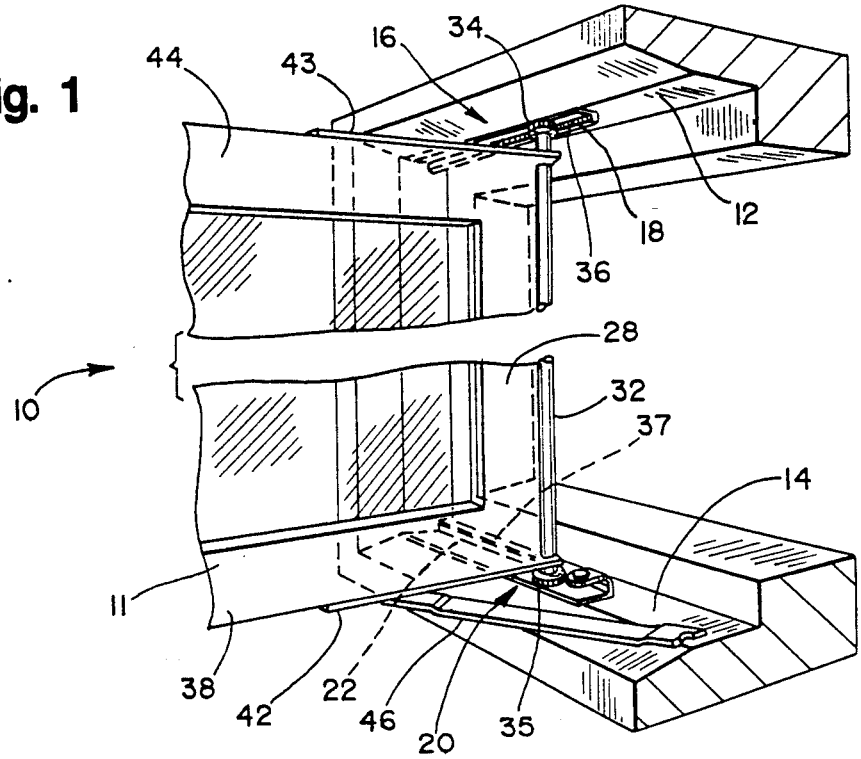
FIG. 1 is a perspective view of a geared casement hinge according to the present invention.

In FIG. 1, a casement window 10 includes a sash 11, a head 12 and a sill 14. An upper hinge 16 mounted to the head 12 includes an upper geared track 18. A lower hinge 20 mounted to the sill 14 includes a lower geared track 22 of the casement window 10. A sash stile 26 (shown in FIG. 4, but omitted for clarity of illustration in FIG. 1) mounted to an inner vertical side 28 of the sash 11 houses a shaft 32 for rotation therein. Upper and lower toothed gears 34,35 fixedly mounted on a top and bottom of the shaft 32 for rotation therewith engage corresponding upper and lower teeth 36, 37 in the upper and lower tracks 18, 22, respectively.

Figure 2:
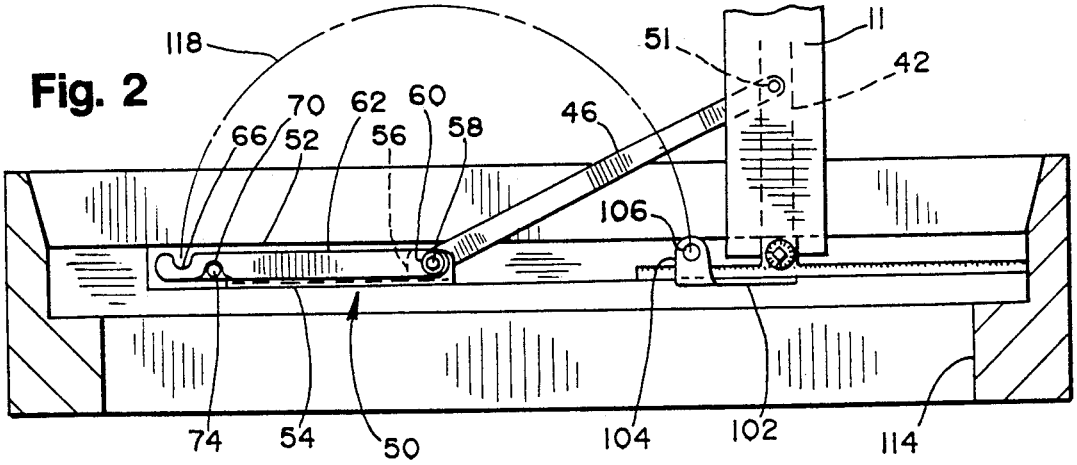
FIG. 2 is a plan view of the geared casement hinge of the present invention in an egress position.

A lower horizontal side 38 of the sash 11 is mounted to and supported by a lower sash arm 42 extending radially from a lower end of the sash stile 26 (FIG. 4). An upper sash arm 43 supports an upper horizontal side 44 of the sash 11 and extends radially from an upper end of the sash stile 26 (FIG. 4). A support arm 46 extends from an anchor mount 50 (FIG. 2) and is rotatably connected to the lower sash arm 42 as by a rivet 51 (FIG. 2). The anchor mount 50 and the lower geared track 22 can be a one-piece unit. The anchor mount 50 includes a horizontally disposed planar portion 52 mounted to the sill 14. An inwardly turned flange 54 includes a down-turned end to form a guide channel for a movable anchor shoe 56. The support arm 46 is rotatably mounted to the movable anchor shoe 56 by a rivet 58 mounted normal to the movable anchor shoe 56 and by a washer 60.

An anchor arm 62 is also rotatably mounted at an end thereof to the rivet 58 of the movable anchor shoe 56. The anchor arm 62 includes a pair of oppositely facing notches 66, 70 adjacent an opposite end thereof. During normal use, the notch 70 engages a rivet or post 74 mounted normal to the horizontal planar portion 52. A comparable structure for converting a hinge to washability positioning is shown in U.S. Pat. No. 4,726,092, the details of which are hereby incorporated by reference.

A side sectional view of the geared casement window hinge 10 is shown in FIG. 4. The upper and lower geared tracks 18, 22 have an L-shaped cross-section. The casement window 12 is slidingly supported on the lower track 22 by a lower C-shaped shoe slider 80 which is connected to a slider pivot 84. The upper and lower sash arms 42,43 are rotatably connected to the slider pivots 84,86, respectively. The upper slider pivot 86 is fixedly mounted to an upper C-shaped shoe slider 87. Sleeves 88 connected to the slider pivots 84,86 extend inside the sash stile 26 to guide the shaft 32.

An upper and lower end of the shaft 32 includes protuberances 94 which engage recesses 96 in the toothed gear 34, as best seen in FIG. 6, causing the upper toothed gear 34 to rotate and engage teeth 36 simultaneously as the lower toothed gear 35 is moved across the teeth 37 on the lower track 22.

As best seen in FIG. 2, the lower C-shaped shoe slider 80 includes an integral extension 102 formed along the lower track 22 between the toothed gear 35 and the anchor mount 50. A flange 104 mounted normal to the extension 102 includes an upwardly facing rivet or post 106. The extension 102, flange 104, and rivet 106 are slidingly received along the lower track 22 as the lower C-shaped shoe slider 80 moves.

An imaginary axis (not shown) extends through the rivet 58 parallel to the shaft 32. The sash arm 42 is pivotally secured about this imaginary axis through support arm 46.

During normal use, an operator engages the notch 70 with the rivet 74 to prevent movement of the movable anchor shoe 56. When opening and closing the casement window 12, the support arm 46 pivots on the rivets 51, 58 and the movable anchor shoe 56 is fixed. The C-shaped shoe slider 80 is slidingly received along the lower track 22. The C-shaped shoe slider 80 and the lower slider pivot 84 guide the toothed gear 35 along the teeth 37 of the lower track 22. The toothed gear 35 thus rotates the shaft 32, turning the upper toothed gear 34 which engages the teeth 36 in the upper track 18 and causes the upper slider pivot 86 and C-shaped shoe slider 87 to move the upper sash arm 43 and the upper horizontal sash 44 in unison with the lower sash arm 42 and lower horizontal sash 38.

Figure 3:
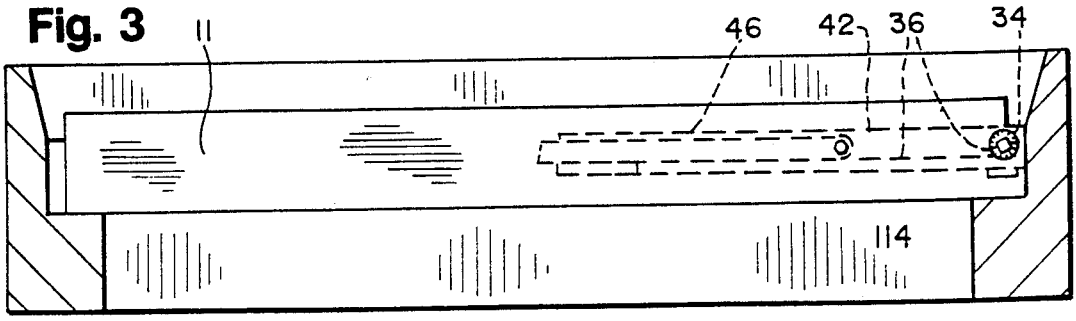
FIG. 3 is a plan view of the geared casement window of the present invention in a closed position.

With the casement window in the closed position in FIG. 3, the interior side of the window can be washed. With the casement window fully open (FIG. 2) in the egress position, the window sash 11 is located next to the window jamb 114 providing a maximum opening with an unobstructed view through the window frame, which opening further permits escape through the window in the event of an emergency. However, insufficient clearance is provided between the vertical sash 28 and the jamb 114 (FIG. 2) for the operator to reach through to wash an exterior side of the casement window 10.

To alleviate this problem, the operator opens the casement window to the egress position shown in FIG. 2. The operator then releases the notch 70 on the anchor arm 62 from the rivet 74 and rotates the anchor arm 62 along an arc 118 to engage the notch 66 on anchor arm 62 with the upwardly facing rivet 106 extending from the flange 104. The engagement of the anchor arm 62 with the rivet 106 secures the shaft 35 at a selected maximum spacing from the imaginary axis that extends through the rivet 58. The movable anchor shoe 56 is thus free to slide along the guide channel with the support arm 46 fixed in the same angular position with respect to the sill 14. As the casement window 10 is moved to provide additional clearance between the jamb 114 and the sash 11 the lower toothed gears 35 engage the teeth 37 causing the shaft 32 and upper toothed gears 34 to rotate and simultaneously move the upper horizontal side 44 of the sash 11.

While the above description relates to casement window hinges, it should be readily apparent that apparats described above can be easily modified to operate with the tracks and hinges mounted vertically, for example, for awning windows.

It should also be understood that, in addition to the above described preferred embodiment allowing the window to be converted between egress and washability modes, the geared casement window hinge of the present invention as described herein could also be used in windows having only one operating mode.

It should further be understood that the geared hinge according to the present invention could also be used with different sliding shoe/track configurations, and different configurations of support arms. For example, the hinges could include no support arms at all (e.g., if used in combination with window operators which themselves guide the motion of the sash during opening and closing). Still further, the geared hinges of the present invention could be four-bar hinges such as shown in, for example, in U.S. Pat. Nos. 5,083,344 and 5,093,960, the detailed disclosures of which are hereby incorporated by reference. When used with four-bar hinges, the gear shaft (reference number 32 in the above described embodiment) would be rotatably secured relative to the sliding shoe of the hinge (not on the end of the sash arm, which is only indirectly linked to the sliding shoe in such hinges), with the gears ensuring that the sliding shoes of both hinges of a hinge pair would move together.

It should now be apparent that the above described geared casement window hinge can be easily and inexpensively manufactured, assembled, and installed. Further, such hinges will provide smooth and reliable operation over the long desired useful life of the casement window within which they are installed. Specifically, since the hinge of the present invention will ensure that both hinges will work together, there is no danger of binding during movement as could occur if, as is typical, a person or mechanical operator applies the opening or closing force to the sash at a point adjacent one of the hinges. Force applied to either the top or bottom of the inner vertical side of the sash will be transferred to the bottom or top by the gears, shaft and teeth in the tracks.

Still further, since one hinge will not bind relative to the other, there is also no danger of twisting of the sash during movement. Therefore, the risk of damaging or even breaking the sash, the hinges, and/or the window glass from twisting of the sash is eliminated.

Geared casement window hinges made according to the present invention can be further advantageously used in windows where it is desirable to provide for washability of the window. For example, in the above described preferred embodiment, the upper hinge 16 does not require the support arm 46, the anchor mount 50, the anchor arm 62, or other corresponding structures. Further, a window sash supported by such a hinge structure can easily be moved to the washability position without any danger of damage due to twisting of the sash during such operation. Still further, changing between normal operation and washability with such a hinge structure requires only one hinge to be manipulated (for changing between different operating modes). Therefore, there is no risk (as with prior art structures) that a person manipulating the hinge might convert only one of the two hinges, and thus the related risk of damaging the window components (as would occur if an operator were to attempt to move the sash when opposite hinges are in different operating modes) is avoided.

Still other aspects, objects and advantages can be obtained from a study of the specification, the drawings and the appended claims.

I claim:

1. In a window having a window sash and window frame, a hinged structure for supporting opposite sides of the sash on the frame, comprising:

first and second tracks on opposite sides of the window frame adjacent said opposite sash sides when said sash is closed;

a shaft having first and second ends;

C-shaped shoes rotatably secured to opposite shaft ends, said C-shaped shoes being slidably secured to each of said tracks and supporting said shaft ends for longitudinal movement along their respective tracks;

gears fixed to opposite ends of said shaft;

racks associated with each of said tracks and engaging said gears;

first and second sash arms secured to the opposite side sashes; and means for carrying said sash arms with said shaft.

2. The hinge structure of claim 1, wherein said carrying means comprises pivotal connections between said sash arms and said shaft.

3. The hinge structure of claim 1, further comprising a support arm pivotally connected at one end to one of the sash arms and pivotally supported on the other end on the window frame.

4. In a window having a window sash and window frame, a hinge structure for supporting opposite sides of the sash on the frame, comprising:

first and second sash arms secured to the opposite sash sides;

means for pivotally securing said first sash arm about an axis;

a shaft between said opposite sash sides;

means for securing said shaft at a selected maximum spacing from said axis;

gears fixed to opposite ends of said shaft;

first and second tracks on opposite sides of the window frame adjacent said opposite sash sides when said sash is closed, said tracks supporting said shaft ends for movement along said opposite sides of the frame;

racks associated with each of said tracks and engaging said gears; and a sash stile connected between said opposite sides of said sash, said sash stile including a sleeve for rotatably guiding said shaft.

5. The hinge structure of claim 4, further comprising C-shaped shoe sliders connected to opposite ends of said shaft and slidably engaged with said first and second tracks.

6. The hinge structure of claim 4, wherein the pivotally securing means comprises a support arm pivotally connected at one end to one of the sash arms and pivotally supported on the other end on the window frame.

7. In a casement window hinge structure for mounting a casement window to a window frame, for providing normal operation of a window sash from a closed position to an egress position, and for providing a washability position, the sash having upper and lower horizontal sides and inner and outer vertical sides, the hinge structure including upper and lower tracks mountable to the frame, upper and lower sash arms on the upper and lower sash sides, said sash arms being pivotable relative to the upper and lower tracks, the improvement comprising:

a shaft having upper and lower ends;

a sash stile including a sleeve receiving said shaft, the sash stile being mounted to the inner vertical sash side for rotatably guiding said shaft;

upper and lower gears mounted on said upper and lower ends of said shaft, respectively, for fixed rotation with said shaft;

means supporting said sash arms for horizontal movement along said tracks; and means on said upper and lower tracks for rotating said upper and lower gears together when said casement window is moved along said upper and lower tracks.

8. The improvement of claim 7 wherein said upper and lower tracks have an L-shaped cross-section, and further comprising:

upper and lower sliders rotatably mounted to said upper and lower sash arms, respectively; and upper and lower C-shaped slider shoes maintaining said upper and lower gears against said upper and lower tracks, respectively.

9. The improvement of claim 7 wherein the rotating means include teeth formed in the upper and lower tracks.

10. The improvement of claim 7 further comprising a support arm pivotally connecting the one sash arm with its associated one track.

11. The improvement of claim 10 wherein said one track includes:

an anchor mount on the window sill;

a mounting shoe pivotally connected to the support arm and supported for movement along said anchor mount; and means for selectively fixing said mounting shoe to said anchor mount for normal operation of said hinge and to said movable shoe for washability operation.

12. The improvement of claim 11 wherein said anchor mount and said one track are integrally formed.

13. The improvement of claim 11 wherein said fixing means includes:

an anchor arm pivotally supported on said mounting shoe and having first and second oppositely facing notches; and a post fixed to the anchor mount and engageable by the first notch to fix the hinge in normal operation.

14. The improvement of claim 13 wherein fixing means further includes a second post fixed to said movable shoe and engageable by the second notch to fix the hinge for washability operation.

15. A casement window, comprising:

a window frame;

first and second tracks mounted on the window frame, each of said tracks including a rack, said tracks having an L-shaped cross-section;

a window sash;

a shaft rotatably mounted on the sash and having opposite ends;

first and second sash arms secured to opposite sides of said sash and pivotally connected to said shaft;

first and second gears secured to the opposite shaft ends;

first and second sliders rotatably mounted to said first and second sash arms, respectively; and first and second C-shaped slider shoes maintaining said first and second gears against said first and second tracks, respectively.

16. The improvement of claim 15 further comprising a support arm pivotally interconnecting an anchor mount on said frame with one of said sash arms.

17. In a window having a window sash and window frame, a hinge structure for supporting opposite sides of the sash on the frame, comprising:

first and second sash arms secured to the opposite sash sides;

means for pivotally securing said first sash arm about an axis;

a shaft between said opposite sash sides;

means for securing said shaft at a selected maximum spacing from said axis;

gears fixed to opposite ends of said shaft;

first and second tracks on opposite sides of the window frame adjacent said opposite sash sides when said sash is closed, said tracks supporting said shaft ends for movement along said opposite sides of the frame;

racks associated with each of said tracks and engaging said gears; and

C-shaped shoe sliders connected to opposite ends of said shaft and slidably engaged with said first and second tracks.

18. In a casement window hinge structure for mounting a casement window to a window frame, for providing normal operation of a window sash from a closed position to an egress position, and for providing a washability position, the sash having upper and lower horizontal sides and inner and outer vertical sides, the hinge structure including upper and lower tracks having an L-shaped cross-section and mountable to the frame, upper and lower sash arms on the upper and lower sash sides, said sash arms being pivotable relative to the upper and lower tracks, the improvement comprising:

a shaft having upper and lower ends;

means mounted to the inner vertical sash side for rotatably guiding said shaft;

upper and lower gears mounted on said upper and lower ends of said shaft, respectively, for fixed rotation with said shaft;

means supporting said sash arms for horizontal movement along said tracks;

means on said upper and lower tracks for rotating said upper and lower gears together when said casement window is moved along said upper and lower tracks;

upper and lower sliders rotatably mounted to said upper and lower sash arms, respectively; and upper and lower C-shaped slider shoes maintaining said upper and lower gears against said upper and lower tracks, respectively.

* * * * *